US010487849B2

(12) United States Patent
Woollenweber

(10) Patent No.: US 10,487,849 B2
(45) Date of Patent: Nov. 26, 2019

(54) INLET GUIDE VANES FOR TURBOCHARGER COMPRESSORS

(71) Applicant: William E. Woollenweber, San Diego, CA (US)

(72) Inventor: William E. Woollenweber, San Diego, CA (US)

( * ) Notice: Subject to any disclaimer, the term of this patent is extended or adjusted under 35 U.S.C. 154(b) by 0 days.

(21) Appl. No.: 15/387,342

(22) Filed: Dec. 21, 2016

(65) Prior Publication Data

US 2017/0175768 A1 Jun. 22, 2017

Related U.S. Application Data

(60) Provisional application No. 62/270,201, filed on Dec. 21, 2015.

(51) Int. Cl.

| | |
|---|---|
| ***F04D 29/54*** | (2006.01) |
| ***F02B 33/40*** | (2006.01) |
| ***F04D 29/42*** | (2006.01) |
| ***F04D 29/44*** | (2006.01) |

(52) U.S. Cl.

CPC ..... *F04D 29/544* (2013.01); *F02B 33/40* (2013.01); *F04D 29/4213* (2013.01); *F04D 29/444* (2013.01); *F05D 2220/40* (2013.01); *F05D 2250/51* (2013.01); *F05D 2250/70* (2013.01); *F05D 2260/14* (2013.01)

(58) Field of Classification Search

CPC ... F04D 29/544; F04D 29/441; F05D 2260/14
See application file for complete search history.

(56) References Cited

U.S. PATENT DOCUMENTS

| | | | | |
|---|---|---|---|---|
| 4,029,433 | A * | 6/1977 | Penny | F01D 17/16 415/147 |
| 4,764,088 | A * | 8/1988 | Kapich | F04D 29/466 415/148 |
| 6,994,518 | B2 * | 2/2006 | Simon | F01D 17/141 415/147 |
| 7,083,379 | B2 * | 8/2006 | Nikpour | F04D 27/0246 415/144 |
| 8,177,498 | B2 * | 5/2012 | Hermann | F02B 37/00 415/200 |
| 2009/0022588 | A1 * | 1/2009 | Chen | F04D 25/0613 415/218.1 |
| 2010/0266395 | A1 * | 10/2010 | Hermann | F02B 37/00 415/191 |

(Continued)

*Primary Examiner* — Justin D Seabe
*Assistant Examiner* — Jason A Fountain
(74) *Attorney, Agent, or Firm* — Donn K. Harms

(57) ABSTRACT

A device and method for imparting a negative pre-whirl to an airstream entering a compressor wheel of a turbocharger. Using a plurality of radially positioned vanes through which the airstream to the compressor wheel communicates, a negative pre-whirl is imparted to the airstream entering the compressor wheel from an intake passage. This pre-whirl is imparted by positioning the vanes radially within an engageable ring and curving the vanes in a direction opposite the direction of rotation of the compressor wheel. Performance is further enhanced by a hub centrally positioned with the vanes where the hub includes a cavity sized to encapsulate a compressor nut and eliminate air turbulence therefrom.

3 Claims, 4 Drawing Sheets

(56) References Cited

U.S. PATENT DOCUMENTS

| | | | | |
|---|---|---|---|---|
| 2015/0192147 | A1* | 7/2015 | An | F04D 29/4213<br>415/58.4 |
| 2017/0152860 | A1* | 6/2017 | Miclea-Bleiziffer | F04D 29/444 |

* cited by examiner

INLET GUIDE VANES FOR TURBOCHARGER COMPRESSORS

This application claims priority to U.S. Provisional Patent Application Ser. No. 62/270,201, filed on Dec. 21, 2015, which is incorporated herein in its entirety by this reference thereto.

FIELD OF THE INVENTION

The disclosed device relates to enhancing the performance of turbochargers. More particularly, the device relates to a component engaged or engageable forward of the air intake for turbochargers such as those employed on gasoline and diesel engines, which so situated, provides a significant increase in the potential boost and efficiency provided by such turbochargers.

BACKGROUND OF THE INVENTION

The air compressor component of turbochargers has evolved through decades of design and development with a goal of maximizing efficiency and flow range, while minimizing the turbocharger rotational inertia. The rotating assembly of a turbocharger consists of the turbine wheel mounted on a first end of a shaft combined with the compressor wheel positioned on the opposite end of the shaft. The shaft is supported by a bearing system in between the two wheels.

In operation, the turbine wheel accepts engine exhaust gas and provides the horsepower to drive the rotating assembly. The spinning of the compressor wheel induces air communicated from the atmosphere through an air cleaner and compresses it. The stream of compressed air is communicated through a compressor casing from which it is delivered to the engine intake manifold.

The acceleration rate of the rotating assembly of a conventional turbocharger, depends on the rotational inertia of the rotating assembly and the friction losses in the bearing system. In operation, engaged with a vehicle to boost engine power, conventional turbochargers work well at engine speeds above idle, but are prone to "turbo lag" which occurs when the engine moves from an idle to accelerate. To minimize the so-called "turbo lag" when the engine throttle is opened to accelerate a vehicle, the rotational inertia of the turbocharger rotor must be minimized. Since the compressor wheel is a vital component of the turbocharger rotor, its inertia must be minimized while, at the same time, the performance of the compressor must be maintained at as high a level as possible. Thus, to minimize the inertia of the small-size compressor wheels employed in automotive turbochargers which conventionally have a minimal size (under 5" in diameter), the number of radial positioned compressor vanes are kept low and the mass of the wheel hub must be as low as possible.

To comply with the restrictions noted above, compressor wheel design has evolved over the years to be of a relatively short length, and be formed with a low number of backward-leaning compressor vanes with sharp leading edges. With proper attention paid to the airflow path running through the wheel passages, and to the design of the diffuser outboard of the wheel, efficiencies of up to 80% are conventionally being achieved. Due to the many years of development and refinement of design methods which have contributed to reaching this high level of efficiency, it is doubtful if further increases in compressor efficiency can be achieved through wheel design alone.

As such, there is an unmet need for a device and method which can improve the performance of conventional turbochargers. Such a device should be employable as a component in newly manufactured turbochargers, as well as be adapted for retrofit engagement to existing turbochargers to provide improvement in performance.

BRIEF SUMMARY OF THE INVENTION

The disclosed device herein and method for employment thereof, provides a means of achieving a significant improvement in the performance of conventional turbocharger compressors. It provides this improvement in a manner which is independent of the compressor wheel design, and can be employed in the construction of newly manufactured turbochargers, and can be configured in a manner wherein it can be adapted for operative engagement to existing turbochargers to thereby improve performance.

The use of compressor inlet pre-whirl is disclosed in prior art and its use in the control of small gas turbines is described in the Transactions of the ASME, J. of Eng. for Power April 1964, page 136. Movable planar inlet pre-whirl vanes have been tested experimentally by turbocharger manufacturers in the laboratory but there has been no practical application of such in commercially available turbochargers. Further, the previously taught designs which have been experimentally investigated, employed moveable flat-plate vanes, which could be positioned to produce either positive or negative pre-whirl in the compressor inlet airflow, depending on an orientation of the vanes. Employing such movable planar vanes, the experimental results have indicated that positive pre-whirl can move the compressor performance map to a lower flow range of both the outlet pressure and lower efficiency. Experimental outcomes employing negative pre-whirl, however, have shown that such a configuration may move the compressor performance map to a higher flow range while concurrently raising the compressor outlet pressure with equal or higher compressor efficiency. However, no reduction to practice of a commercially employable product for newly manufactured turbochargers or to retrofit previously manufactured turbochargers has been accomplished.

The disclosed device and method herein is configured to yield improved performance with turbochargers using negative pre-whirl (to be defined later). This is accomplished by utilizing radially positioned fixed negative pre-whirl vanes upstream of the compressor wheel. These fixed negative pre-whirl vanes can be included in the formation of newly manufactured turbochargers. Further, the disclosed system can be engaged with either newly-manufactured or existing turbochargers through a configuration positioning the pre-whirl blades within a ring which may be engaged within the compressor casing, upstream of the compressor wheel, in any new or existing turbocharger.

As disclosed, the device, as configured herein, does not require any change in the turbocharger construction except in some modes where a single machining operation in the air inlet section of the compressor casing can accommodate the insertion of the pre-whirl vane ring.

Additionally, to further enhance the performance gain of the device, the hub of the vane ring can be formed in a bullet-shaped configuration having a recess formed on one end which is adapted to cover the conventional rotor lock nut. The formed airstream by the pointed end of the bullet-shaped hub thus further enhances airflow into the inducer vanes by eliminating the uneven flow produced by the rotation of conventional hex-shaped rotor lock nuts. The result being a smooth, uninterrupted flow of air into the inducer vanes of the compressor wheel communicated from the fixed vanes of the pre-whirl vane ring, and the elimination of turbulence caused by the conventional hex-shaped rotor nut. The smooth flow of intake air produced by the device and method herein will become apparent when examining the subsequent drawings. Further, the cost of implementing the disclosed device is minimal thereby encouraging widespread use as it consists of a vane ring typically easily manufactured in plastic or metal material.

With respect to the above description, before explaining at least one preferred embodiment of the herein disclosed turbocharger enhancement invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed turbocharger enhancing device. It is important, therefore, that the claims be regarded as including such equivalent construction and methodology insofar as they do not depart from the spirit and scope of the present invention.

DETAILED DESCRIPTION OF THE PREFERRED EMBODIMENTS OF THE INVENTION

Current design practice consists of selecting a reasonable value for the velocity of the compressor inlet airflow (such as 250'/sec) and designing for constant axial inlet velocity over the radius of the compressor wheel inducer vanes.

Figure 1:
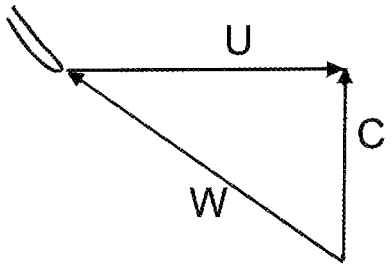
FIG. 1 depicts the turbocharger air inlet velocity triangle, taken at the inducer geometric mean diameter.

Shown in FIG. 1 is a typical air inlet velocity triangle, showing the inlet velocity at the geometric mean diameter of the compressor wheel inducer. The non-movable pre-whirl vanes of the device and method herein are configured to impart a direction to the absolute air inlet velocity of an airstream being communicated to the compressor wheel, which is opposite to the rotation of the compressor wheel.

Figure 2:
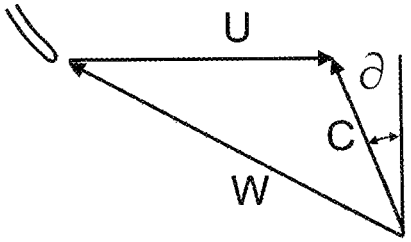
FIG. 2 is a turbocharger compressor air inlet velocity triangle, showing the effect of negative pre-whirl.

As depicted in FIG. 2, the negative pre-whirl angle, $\alpha$, a current range for optimal performance improvement would be in the range of 15° to 25°. However, other pre-whirl angles for example in a range between 5° to 50° can be chosen for specific compressor performance enhancements. Additionally, while curved vanes are preferred herein as experimentation has shown such to provide significant improvement in compressor performance, planar or straight vanes might also be employed in the device herein and still yield a slight performance increase of the turbocharger, and while not optimum, such a configuration is anticipated within the scope of this application.

In the graphic depictions of FIGS. 1 and 2, U represents the wheel velocity, C the absolute air inlet velocity, and W the relative air inlet velocity, usually plotted in feet per second. The compressor wheel inducer vanes in FIG. 1 are designed to match the angle of the relative air inlet velocity W.

Figure 3A:
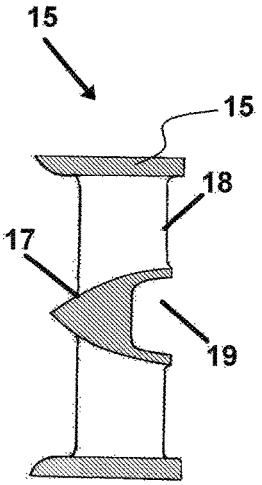
FIG. 3*a* depicts a cross section of a pre-whirl vane ring which may be adapted for engagement within existing and newly manufactured turbochargers.
Figure 3:
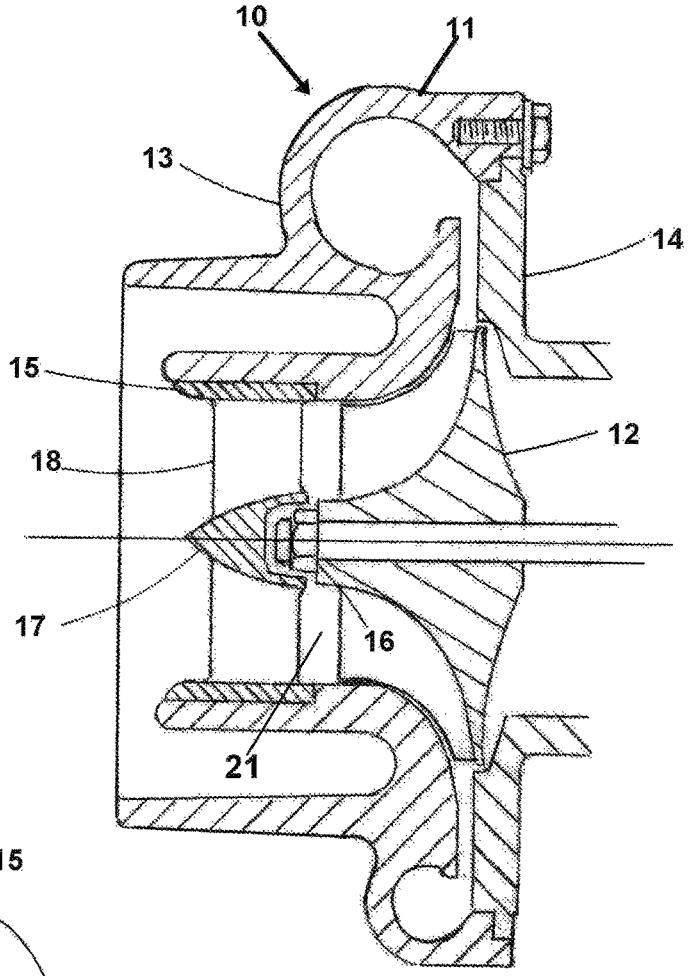
FIG. 3 is a cross section of a typical turbocharger compressor component showing the addition of the pre-whirl vane ring herein disclosed positioned within the passage providing an airstream to the compressor wheel, and shown in FIG. 3*a*.
Figure 3B:
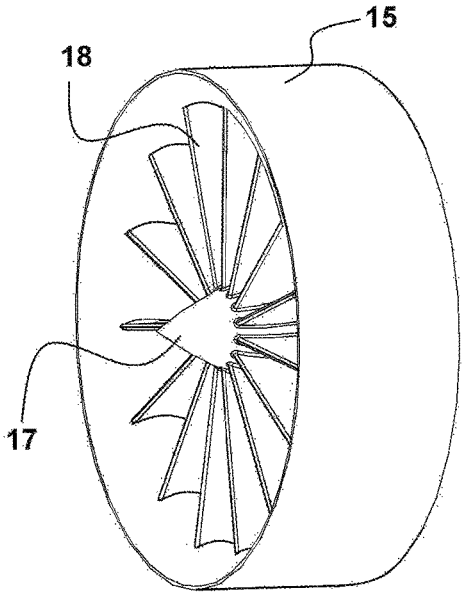
FIG. 3*b* depicts a perspective view of the device such as in FIGS. 3 and 3*a*, configured for operative positioning upon a turbocharger.

FIG. 3 shows a cross section of the turbocharger compressor device 10 and method herein having a pre-whirl component shown as a vane ring 15 operatively positioned in operative engagement within a typical turbocharger 11, consisting of a compressor wheel 12, a compressor casing 13, and a back plate 14. In such operative positioning, the device 10 is positioned in front of the compressor wheel 12 and within the passage 21 communicating an incoming airstream to the compressor wheel 12. FIG. 3 also illustrates the positioning of fixed pre-whirl vanes 18, which as shown are formed as a vane ring 15, and which are positioned within the air inlet section of the compressor casing 13 in accordance with the invention. It should be noted that in newly manufactured turbochargers the vanes 18 providing the pre-whirl could be operatively positioned without the ring and any such positioning of vanes 18 to communicate a negative pre-whirl to the stream of incoming air to the compressor wheel 12 of a turbocharger 11 is considered within the scope of this patent.

A conventional turbocharger rotating assembly is clamped together by a rotor lock nut 16 which usually has a hexagonal shape for engagement of a wrench to tighten the assembly. The hexagonal shape of the lock nut 16, rotating at very high speed in current turbochargers, produces a turbulence in the inlet airflow. This turbulence impairs the airflow into the compressor wheel 12 and the overall performance of the turbocharger.

Alone, or in combination with the plurality of pre-whirl vanes 18 herein, the positioning of a cone or bullet-shape hub 17 which is configured at a second end with a cavity 19 adapted to surround and encapsulate the lock nut 16, eliminates or significantly reduces any turbulence in the inlet airflow, caused by the high speed of rotation of the lock nut 16. As noted this hub 17 may be employed without the pre-whirl vanes 18 and yield a performance increase to the turbocharger by elimination of turbulence in the incoming airstream and such is anticipated. However, employment of the pointed or bullet shaped hub 17 in combination with the pre-whirl vanes 18 is particularly preferred as a symbiotic relation therebetween provides significant enhancement of airflow provided to the compressor wheel 12 from that of conventional turbochargers.

The pre-whirl vanes 18 in the pre-whirl vane ring 15 are curved to thereby impart a rotation to the airflow communicated to the compressor wheel 12 through the passage 21 communicating an incoming airstream to the compressor wheel 12, in a direction opposite to the rotation of the compressor wheel 12. This opposite direction rotation of the inlet airflow through the passage 21 is usually designated as "negative pre-whirl". Negative pre-whirl directs the inlet airflow into the compressor wheel 12 in such a way that the mass flow of inlet air is increased, and the pressure generated by the compressor 12 is also increased. Depending on the design of the compressor wheel 12, the efficiency can be higher with negative pre-whirl imparted to the incoming airstream.

Figure 4:
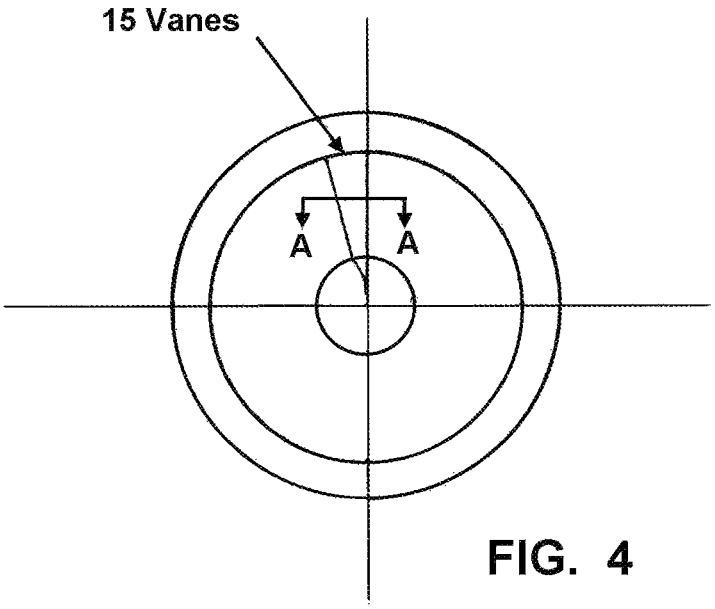
FIG. 4 is a front view showing one preferred mode of the pre-whirl vane ring having a plurality of radially positioned vanes, as in FIGS. 3 and 3*a*.

FIG. 4 shows a front view of a negative pre-whirl vane ring 15. While shown employing fifteen vanes 18, which is a current preferred mode, the vane ring 15 can have anywhere from three vanes 18 to fifty vanes 18 depending on the cross section of the vane ring 15 and configuration of the compressor wheel 12 receiving the pre-whirl airflow through the passage 21 (FIG. 3) which is generated by the curve of the vanes 18 of the vane ring 15.

Figure 5:
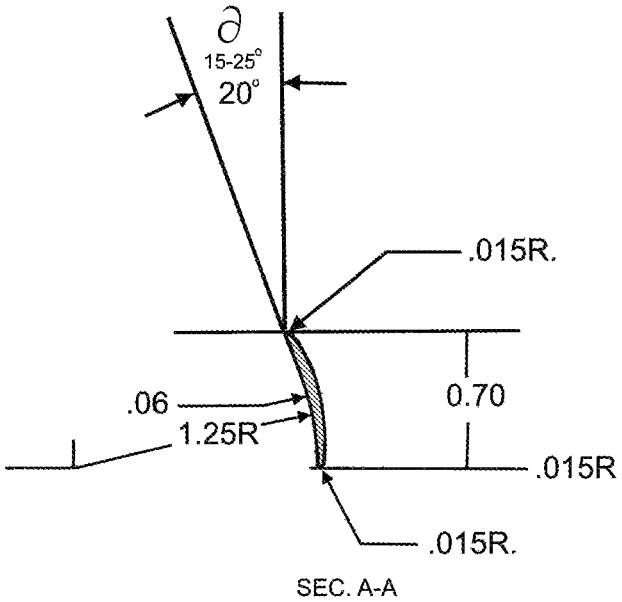
FIG. 5 is a section through of one pre-whirl vane showing a preferred curvature of the vane to impart negative pre-whirl to the airstream communicated thereover and to the compressor wheel.

FIG. 5 is a section through one pre-whirl vane 18, showing how the vane curvature turns the inlet airflow from a substantially laminar flow, along an axial direction, through the passage 21 and causes the airstream to enter the compressor wheel 12 at a small angle opposite to the counter clockwise wheel rotation of the compressor wheel 12 (see FIG. 2).

Figure 6:
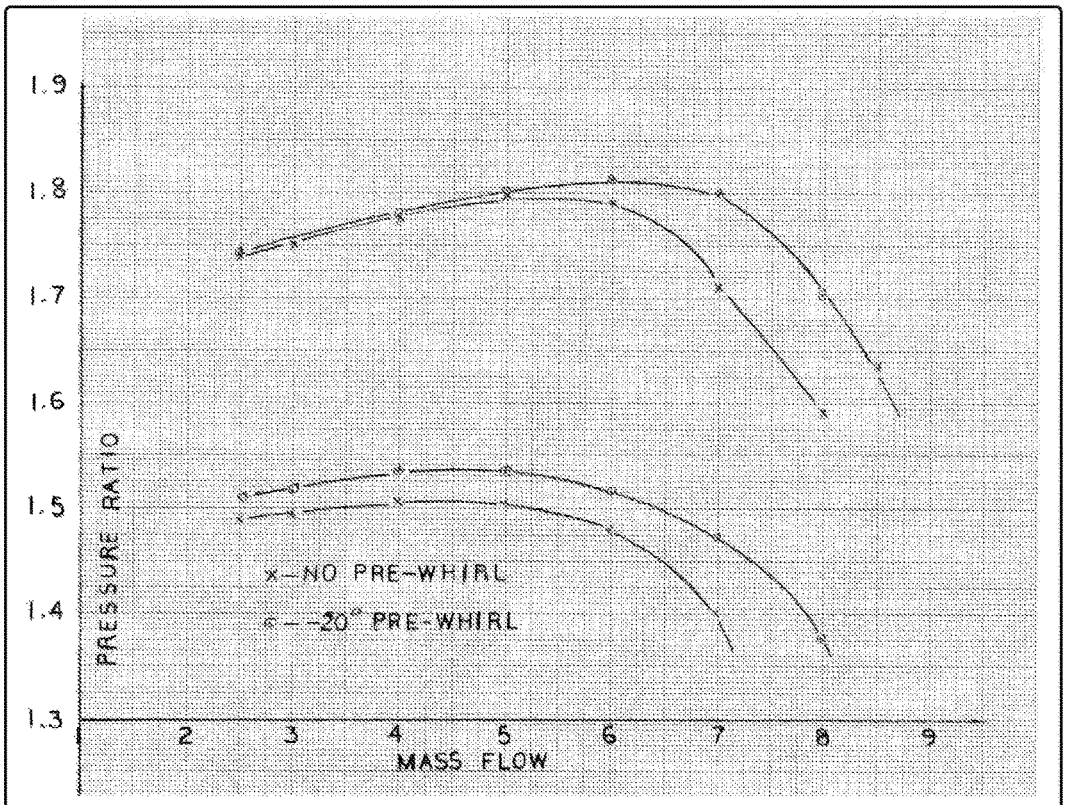
FIG. 6 is a graphic depiction of experimental compressor performance results of the prior art negative pre-whirl produced by movable flat plate vanes.

A limited amount of experimental data is reproduced from prior art literature has in theory shown a potential increase in mass flow and pressure ratio produced by −20 degrees rotatable flat plate pre-whirl vanes (see FIG. 6). However, such is just research and theory, and in some cases teaches the employment of rotating flat vanes rather than fixed vanes, if the taught calculations were employed to reduce the taught configuration to practice.

Figure 7:
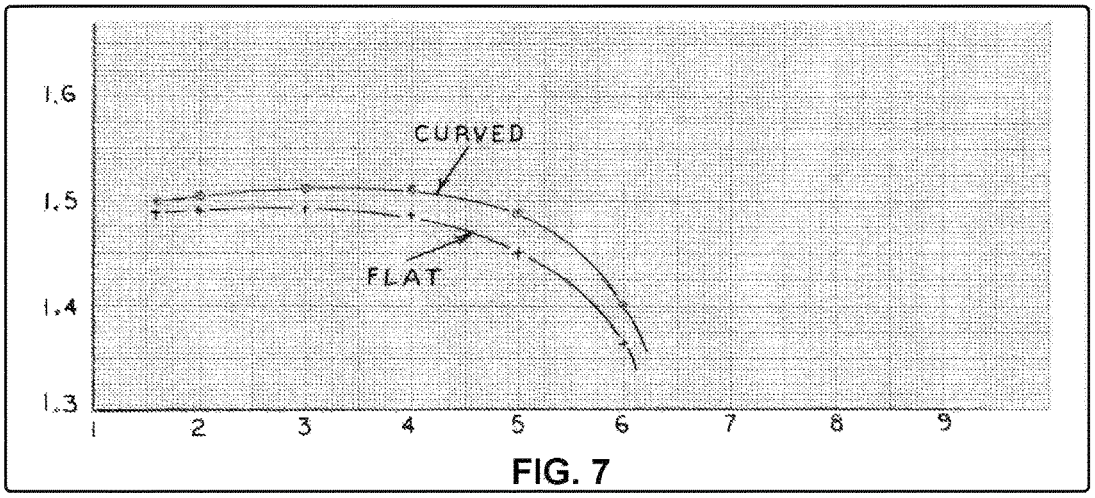
FIG. 7 is a graphic depiction of compressor performance comparing such flat plate vanes and the curved pre-whirl vanes herein disclosed.

FIG. 7 illustrates an improvement in performance based on the disclosed device and method herein, comparing the previously taught pre-whirl flat plate vanes and the device and method herein positioning curved pre-whirl vanes 18 and combining such with an axially positioned hub 17, in a vane ring 15 configuration, to deliver a turbulence-free negative pre-whirl airflow to a turbocharger compressor 12.

The negative pre-whirl vane ring 15 with the bullet-shaped hub 17 can be made as an inexpensive aluminum casting or fabricated from other materials. In this ring configuration, the vane ring 15 may be inserted in the inlet section of new or existing compressor casings, as shown in FIG. 3, by forming the casing in a manner adapted to circumferentially engage the vane ring 15 or through a simple machining operation in the casing air inlet section. Thus, this invention provides an inexpensive means of significantly improving the performance of small turbocharger compressors that will result in a significant improvement in performance of the engines on which such turbochargers are mounted, and in the performance of vehicles in which the turbocharged engines are used.

The unique negative pre-whirl vane ring 15 of the device and method herein employs curved vanes 18 and a bullet-shaped hub 17, which yields a significant increase in flow range and pressure ratio obtained from the turbocharger compressor. The graphic depiction in FIG. 7 indicates that curved vanes 18 can increase the flow range and pressure ratio over that obtained using previously taught movable flat plate vanes. Thus, the combination of curved vanes 18 fixed in position within a vane ring 15 of this invention, combined with a bullet-shaped hub 17, in a combined symbiotic configuration, will improve the flow range and pressure ratio of turbocharger compressors to a significant degree over the prior art.

While all of the fundamental characteristics and features of the turbocharger pre-whirl, device and method have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications, variations and substitutions are included within the scope of the invention as defined by the following claims.

What is claimed is:

1. A turbocharger intake air apparatus, comprising:

a plurality of vanes;

each of said plurality of vanes mounted in respective permanently fixed radially oriented position within a passage of a compressor casing which communicates an incoming airstream to a compressor wheel of a turbocharger; and said vanes shaped to impart a negative pre-whirl to said airstream communicated through said passage and thereover and to said compressor wheel of said turbocharger; and said negative pre-whirl imparted to said airstream by said plurality of vanes being in a direction of rotation of said airstream which is opposite a rotational direction of said compressor wheel; and said plurality of radially oriented vanes being curved in a direction opposite to said rotational direction of said compressor wheel; and said plurality of vanes in said radially oriented positions each extending from a center point to distal ends; and a ring fixedly engaged with each of said distal ends, said ring adapted for a fixed circumferential engagement of an exterior circumference of said ring, with a surface defining said passage of said turbocharger which communicates said airstream to said compressor wheel.

2. The turbocharger intake air apparatus of claim 1, additionally comprising:

a hub fixed in a position at said center point, said hub curving to a point on a first end and having a cavity at a second end opposite said first end; and said cavity sized to encapsulate a lock nut engaged at a front of said compressor wheel, whereby turbulence from said lock nut formed in said airstream communicated to said compressor wheel is eliminated.

3. A turbocharger intake air apparatus, comprising:

a plurality of vanes;

each of said plurality of vanes in a radially oriented position around a center point and extending from said center point to respective distal ends; and each of said distal ends of said plurality of vanes in a fixed connection and thereby fixed in orientation and position with an internal circumferential surface of a ring;

said ring having an external circumferential surface configured for an engagement to a fixed position within an intake air passage communicating an airstream to a compressor wheel of a turbocharger; and whereby said plurality of vanes in said radially oriented positions within said ring located in said fixed position in said intake passage, impart a negative pre-whirl to an airstream passing through said ring and thereover, to said compressor wheel of said turbocharger; and wherein said fixed position is formed by an engagement of said external circumferential surface of said ring in a fixed contact against an internal surface of said intake air passage.

* * * * *